US008078075B2

(12) United States Patent
Kim

(10) Patent No.: US 8,078,075 B2
(45) Date of Patent: Dec. 13, 2011

(54) IMAGE FORMING APPARATUS AND METHOD TO CLEAN STAINED PORTION OF IMAGE FORMING APPARATUS

(75) Inventor: Young-min Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 37 days.

(21) Appl. No.: 12/495,866

(22) Filed: Jul. 1, 2009

(65) Prior Publication Data

US 2010/0061744 A1 Mar. 11, 2010

(30) Foreign Application Priority Data

Sep. 9, 2008 (KR) ..... 2008-0088813

(51) Int. Cl.
*G03G 21/00* (2006.01)

(52) U.S. Cl. ..... 399/71; 399/43; 399/99; 399/101; 399/343; 430/126.2

(58) Field of Classification Search ..... 399/71, 399/24, 27, 98, 99, 100, 101, 43, 82, 327, 399/343; 430/125.31, 125.4, 126.2
See application file for complete search history.

(56) References Cited

U.S. PATENT DOCUMENTS 5,832,336 A * 11/1998 Kawasaki et al. ..... 399/71
6,029,025 A * 2/2000 Sakakibara et al. ..... 399/71
6,029,029 A * 2/2000 Danzuka ..... 399/100
6,665,514 B1 * 12/2003 Miyazaki ..... 399/327
7,596,335 B2 * 9/2009 Fukami et al. ..... 399/71
7,747,183 B2 * 6/2010 Yamaki ..... 399/43
7,783,239 B2 * 8/2010 Yamanaka et al. ..... 399/327
7,792,458 B2 * 9/2010 Ota ..... 399/98
2003/0049037 A1 * 3/2003 Sadowara et al. ..... 399/27
2005/0078981 A1 * 4/2005 Ishiyama et al. ..... 399/129
2005/0095027 A1 * 5/2005 Hatakeyama et al. ..... 399/98
2006/0285873 A1 * 12/2006 Saeki ..... 399/101
2007/0048001 A1 3/2007 Yamada
2008/0124117 A1 * 5/2008 Muraishi et al. ..... 399/100
2009/0060554 A1 * 3/2009 Kosuge et al. ..... 399/71

FOREIGN PATENT DOCUMENTS

JP 11-143307 A * 5/1999
JP 2007-057629 3/2007
JP 2007-065086 3/2007

* cited by examiner

*Primary Examiner* — Sophia S Chen
(74) *Attorney, Agent, or Firm* — Stanzione & Kim, LLP

(57) ABSTRACT

An image forming apparatus including a case, a printing medium feeding unit disposed in the case to feed printing media, an image forming unit disposed in the case to form images on a printing medium fed from the printing medium feeding unit using developer and to include at least one portion being stained when the images are formed, and a control portion to control the image forming unit to form the images in a plurality of print modes. The control portion sends a cleaning command to clean the at least one stained portion when the amount of the developer used by the image forming unit reaches a reference amount of the developer or when the number of the printing media supplied by the printing medium feeding unit reaches a reference value of the number of the printing media.

20 Claims, 8 Drawing Sheets

FIG. 3

| | | RESOLUTION (dpi) | | PRINT DENSITY | | | DEVELOPER SAVING | | PRINT DATA | | | FEED METHOD | | ENVIRONMENT | | | PRINTING MEDIA SELECTION |
|---|---|---|---|---|---|---|---|---|---|---|---|---|---|---|---|---|---|
| | | 600 | 1200 | MEDIUM | LIGHT | DARK | OFF | ON | NORMAL | TEXT | IMAGE | SIMPLEX | DUPLEX | LL | NN | HH | |
| MONO PRINT MODE | BLACK | 1 | 1.5 | 1 | 0.8 | 1.2 | 1 | 0.7 | 1 | 0.7 | 1.1 | 1 | 1.2 | 0.7 | 1 | 1.2 | |
| FOUR COLOR PRINT MODE | CYAN | | | | | | | | | | | | | | | | |
| | MAGENTA | | | | | | | | | | | | | | | | |
| | YELLOW | | | | | | | | | | | | | | | | |
| | BLACK | | | | | | | | | | | | | | | | |
| FIVE OR MORE MULTI-COLOR PRINT MODE | CYAN | | | | | | | | | | | | | | | | |
| | MAGENTA | | | | | | | | | | | | | | | | |
| | YELLOW | | | | | | | | | | | | | | | | |
| | BLACK | | | | | | | | | | | | | | | | |
| | WHITE | | | | | | | | | | | | | | | | |
| | TRANSPARENT | | | | | | | | | | | | | | | | |

IMAGE FORMING APPARATUS AND METHOD TO CLEAN STAINED PORTION OF IMAGE FORMING APPARATUS

CROSS-REFERENCE TO RELATED APPLICATIONS

This application claims priority under 35 U.S.C. §119(a) from Korean Patent Application No. 2008-88813 filed Sep. 9, 2008 in the Korean Intellectual Property Office, the disclosure of which is incorporated herein by reference in its entirety.

BACKGROUND

1. Field of the Invention

The present general inventive concept relates to an image forming apparatus to form images using developer. More particularly, the present general inventive concept relates to an image forming apparatus capable of cleaning a portion stained by developer, and a method to clean a stained portion of the image forming apparatus.

2. Description of the Related Art

Generally, when an image forming apparatus to form images using developer, such as toner or ink, forms images, the developer stains an image forming unit disposed inside the image forming apparatus.

If the image forming unit is stained, stained portions affect a printing process thereof so that the image forming apparatus cannot provide good quality printed matters. Therefore, cleaning the stained portions is required.

The conventional image forming apparatus is configured to measure printing time and to clean the stained portions at predetermined printing time intervals.

If an image forming apparatus has an image forming unit provided with a cleaning unit, the image forming apparatus controls the cleaning unit at predetermined time intervals to clean the stained portions of the image forming unit. An image forming apparatus that does not have a cleaning unit is configured, at predetermined time intervals, to inform a user of the performance of a cleaning operation via an indicating device such as a display unit.

However, the conventional image forming apparatus may provide poor quality printed matters when a printing condition is changed.

SUMMARY

The present general inventive concept provides an image forming apparatus that can change cleaning conditions according to a change of printing conditions, and can clean so as to provide good quality printed matters, and a method to clean stained portions of the image forming apparatus.

Additional features and utilities of the present general inventive concept will be set forth in part in the description which follows and, in part, will be obvious from the description, or may be learned by practice of the general inventive concept.

Embodiments of the present general inventive concept can be achieved by providing an image forming apparatus, including a case, a printing medium feeding unit disposed in the case to feed printing media, an image forming unit disposed in the case to form images on the printing media fed from the printing medium feeding unit using developer, and to include at least one portion that becomes stained when the image is formed, and a control portion to control the image forming unit to form the images in a plurality of print modes, the control portion to send a first cleaning command to clean the at least one stained portion when the amount of the developer used by the image forming unit reaches a first reference amount of the developer or when the number of the printing media supplied by the printing medium feeding unit reaches a first reference value of the number of the printing media, the control portion to send a second cleaning command to clean the at least one stained portion when the amount of the developer used by the image forming unit reaches a second reference amount of the developer or when the number of the printing media supplied by the printing medium feeding unit reaches a second reference value of the number of the printing media.

The control portion may calculate a sum of the number of dots of the images formed by the image forming unit, read the developer usage amount per dot corresponding to the selected print modes from a memory, and multiply the sum of the number of dot and the developer usage amount per dot to calculate a total usage amount of the developer.

The developer usage amount per dot may be determined according to at least one among a mono print mode, a four color print mode, a five or more multi-color print mode, a resolution selection mode, a print density selection mode, a developer saving selection mode, a print data selection mode, a feed method selection mode, a printing media selection mode and an environment selection mode.

The control portion may calculate the amount of each of at least one color developer used to form at least one dot of the image according to at least one mode selected among a resolution selection mode, a print density selection mode, a developer saving selection mode, a print data selection mode, a feed method selection mode, a printing media selection mode, and an environment selection mode and may calculate total usage amount of the developer.

The first and second reference values of the number of printing media may be determined according to type and/or size of the printing medium, and may be stored in a memory of the control portion.

The first and second reference values of the number of printing media may be determined as the number of standard printing media, and the number of printing media different from the standard printing media in size and/or type is calculated based on a weight with respect to the standard printing media.

The image forming apparatus may include a cleaning unit formed to clean the at least one stained portion of the image forming unit; wherein the control portion sends the first and/or second cleaning command to control the cleaning unit.

The control portion may control the cleaning unit for a period of time during which the at least one stained portion is cleaned.

When the cleaning unit applies bias to clean the at least one stained portion, the control portion may control the absolute value magnitude of the bias to be applied by the cleaning unit.

The image forming unit may include at least one of a photosensitive medium, a transfer medium, a exposure device, a charging device, a fusing device, and a density detecting sensor, and wherein during a printing operation, at least one of the photosensitive medium, the transfer medium, the exposure device, the charging device, the fusing device, and the density detecting sensor is stained by the developer.

First and second cleaning operations performed by the first and second cleaning commands may include a different cleaning time, cleaning strength, and cleaning cycle.

Embodiments of the present general inventive concept can also be achieved by providing a method to clean at least one stained portion of an image forming apparatus that uses developer to form image that may include calculating the number of dots of the formed image, calculating the usage amount of the developer using the number of dots, determining whether the usage amount of the developer reaches a first reference amount of the developer or a second reference amount of the developer, sending a first cleaning command to clean the at least one stained portion when the usage amount of the developer reaches the first reference amount of the developer, and sending a second cleaning command to clean the at least one stained portion when the usage amount of the developer reaches the second reference amount of the developer.

The calculating the usage amount of the developer using the number of dots may include multiplying the number of dots and a developer usage amount per dot.

The developer usage amount per dot may be determined according to at least one among a mono print mode, a four color print mode, a five or more multi-color print mode, a resolution selection mode, a print density selection mode, a developer saving selection mode, a print data selection mode, a feed method selection mode, a printing media selection mode, and an environment selection mode.

The calculating the usage amount of the developer using the number of dot may include calculating the amount of each of at least one color developer used to form at least one dot of the image according to at least one mode selected among a resolution selection mode, a print density selection mode, a developer saving selection mode, a print data selection mode, a feed method selection mode, a printing media selection mode, and an environment selection mode, and calculating a total usage amount of the developer.

The image forming apparatus may include at least one of a photosensitive medium, a transfer medium, an exposure device, a charging device, a fusing device, and a density detecting sensor. During a printing operation, at least one of the photosensitive medium, the transfer medium, the exposure device, the charging device, the fusing device, and the density detecting sensor may be stained by the developer.

Each of the photosensitive medium, the transfer medium, the exposure device, the charging device, the fusing device, and the density detecting sensor may include a cleaning unit formed to clean a stained portion of each of at least one of the photosensitive medium, the transfer medium, a light window of the exposure device, the charging device, the fusing device, and the density detecting sensor.

Embodiments of the present general inventive concept can also be achieved by providing a method to clean stained portion of an image forming apparatus that uses developer to form image on printing media that may include calculating the number of the printing media being printed, determining whether the number of the printing media reaches a reference value of the number of the printing media, and sending a cleaning command to clean the stained portion when the number of the printing media reaches the reference value of the number of the printing media.

The reference value of the number of the printing media may be determined according to type and/or size of the printing medium.

The reference value of the number of printing media may be determined as the number of standard printing media, and the number of printing media different from the standard printing media in size and/or type is calculated based on a weight with respect to the standard printing media.

Other objects, advantages and salient features of the present general inventive concept will become apparent from the following detailed description, which, taken in conjunction with the annexed drawings, discloses exemplary embodiments of the present general inventive concept.

BRIEF DESCRIPTION OF THE DRAWINGS

These and/or other features and utilities of the present general inventive concept will become apparent and more readily appreciated from the following description of the embodiments, taken in conjunction with the accompanying drawings of which:

FIG. 3 is a table illustrating various printing modes that can be set in the image forming apparatus of FIG. 1;

DETAILED DESCRIPTION OF THE EMBODIMENTS

Figure 1:
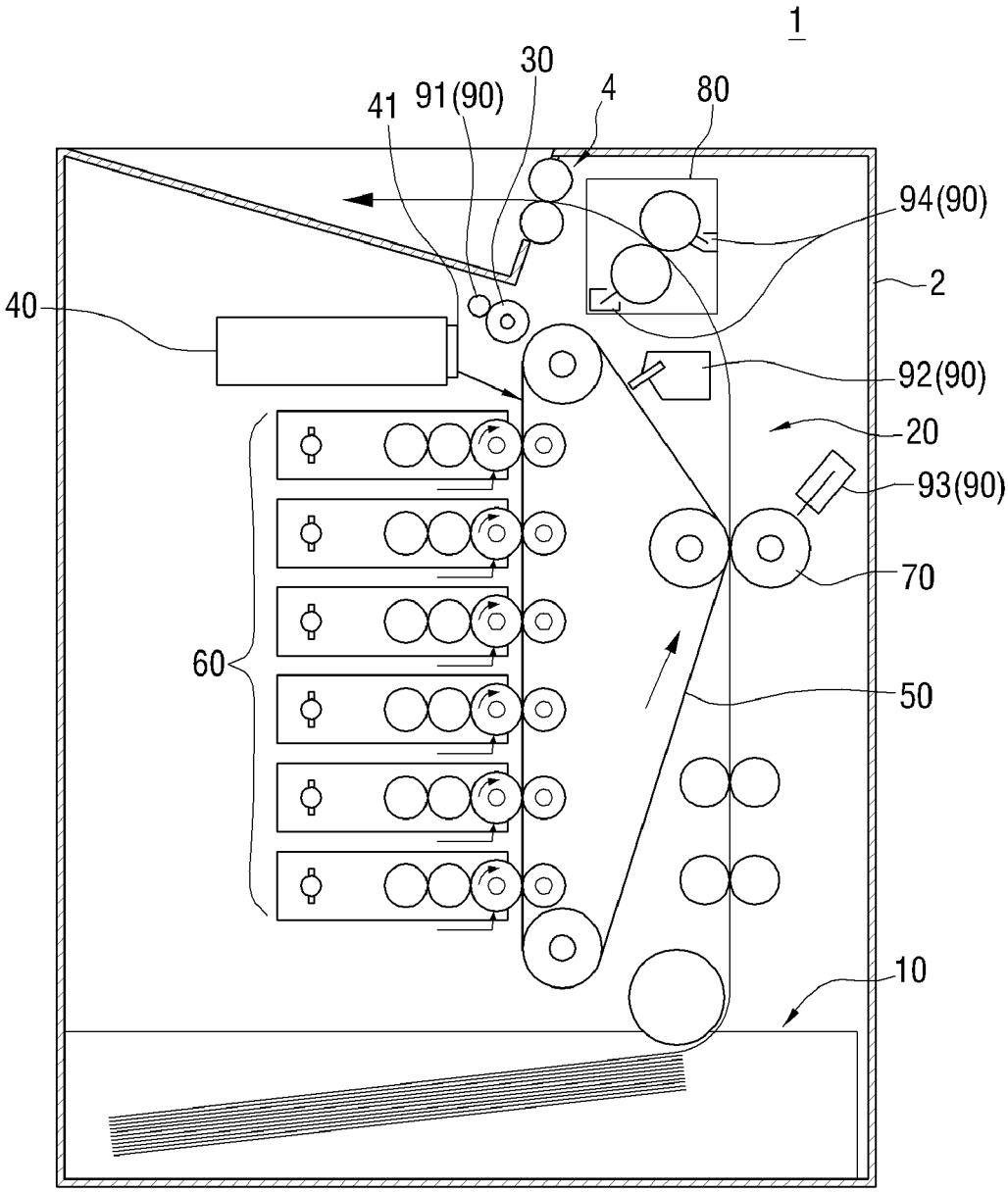
FIG. 1 is a sectional view schematically illustrating an image forming apparatus according to an exemplary embodiment of the present general inventive concept.

Reference will now be made in detail to exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

The matters defined in the description, such as a detailed construction and elements thereof, are provided to assist in a comprehensive understanding of the present general inventive concept. Thus, it is apparent that the present general inventive concept may be carried out without those defined matters. Also, well-known functions or constructions are omitted to provide a clear and concise description of exemplary embodiments of the present general inventive concept.

Figure 2:
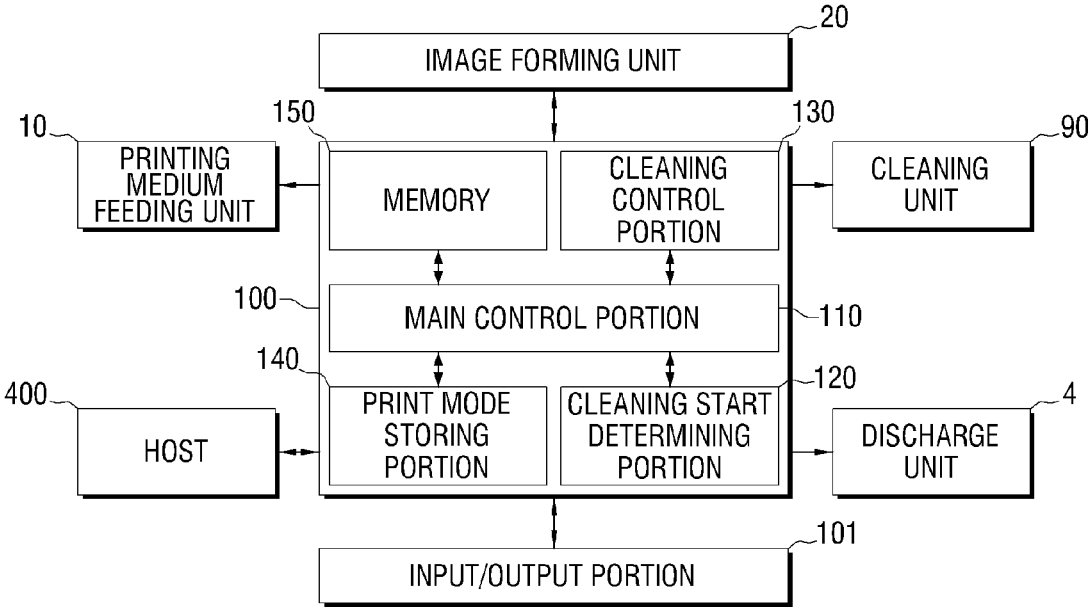
FIG. 2 is a functional block diagram illustrating the image forming apparatus of FIG. 1.

FIG. 1 is a sectional view schematically illustrating an image forming apparatus 1 according to an exemplary embodiment of the present general inventive concept. FIG. 2 is a functional block diagram illustrating the image forming apparatus 1 of FIG. 1.

Referring to FIGS. 1 and 2, the image forming apparatus 1 according to an exemplary embodiment of the present general inventive concept may include a case 2, a printing medium feeding unit 10, an image forming unit 20, a cleaning unit 90, a discharging unit 4, and a control portion 100.

The case 2 forms an outer appearance of the image forming apparatus 1. The printing medium feeding unit 10, the image forming unit 20, the cleaning unit 90, the discharging unit 4, and the control portion 100 may be disposed inside the case 2.

The printing medium feeding unit 10 stores predetermined sheets of printing media, and picks up the stored printing media one by one to feed each of the picked up printing medium toward the image forming unit 20. The printing medium feeding unit 10 may be formed to store and/or feed various types of printing media. Therefore, the printing medium feeding unit 10 can feed various sizes of printing media such as A5, A4, A3, B5, B4, Letter, Legal, Folio, etc. Also, the printing medium feeding unit 10 can feed various types of printing media such as common paper, cotton paper, envelopes, postcards, label paper, laminating films (or over head projection films), etc.

Figure 6:
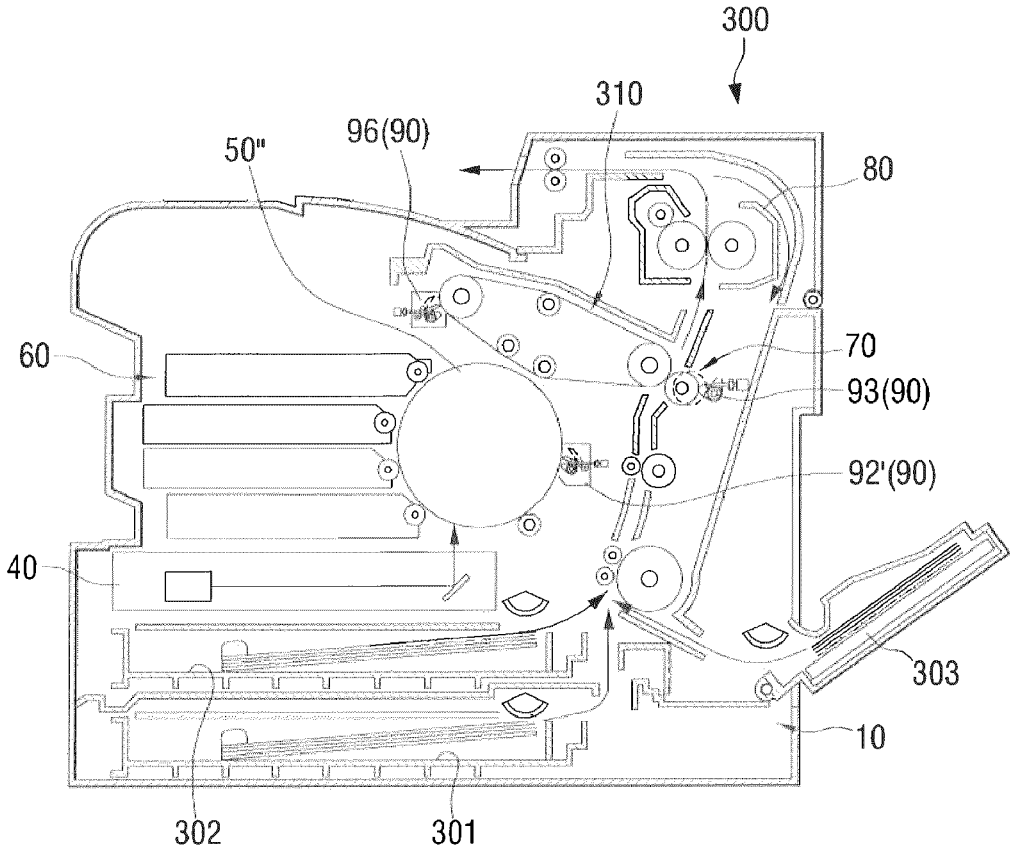
FIG. 6 is a sectional view schematically illustrating an image forming apparatus, according to an exemplary embodiment of the present general inventive concept to have an intermediate transfer belt.

The printing medium feeding unit 10, as illustrated in FIG. 6, may include two or more paper feeding cassettes, such as paper feeding cassettes 301 and 302. Also, the printing medium feeding unit 10 may include an auxiliary printing medium supplying portion 303 capable of feeding various types of printing media.

The image forming unit 20 forms images on the printing medium fed from the printing medium feeding unit 10 using developer. The image forming unit 20 of the image forming apparatus 1 according to this exemplary embodiment uses toner as the developer. The image forming unit 20 may include a charging device 30, an exposure device 40, a photosensitive medium 50, a plurality of developing devices 60, a transfer medium 70, and a fusing device 80.

The charging device 30 charges a surface of the photosensitive medium 50 with a predetermined bias, and may use a corona method to charge the surface of the photosensitive medium 50. The corona method may include a corotron method, and a scorotron method, which are classified by whether the method uses a shield member. When staining materials, such as developer remaining after a transfer process, paper dust of the printing medium, outside dust, etc, attach themselves to a wire of the charging device 30, the charging device 30 cannot charge the surface of the photosensitive medium 50 so as to create a printing defect. The charging device 30 may be configured to be automatically cleaned by a charging cleaning device 91. Alternatively, the charging device 30 may be configured so that when the control portion 100 alerts a user to clean the charging device 30 via an input/output portion 101, the user manually cleans the charging device 30. The charging device 30 may be formed by one of the following methods: a roller method using a cylindrical roller, a pin scorotron method using a plane plate, and a brush method using a brush formed in thin hair. All charging devices 30 formed by the roller method, the pin scorotron method, or the brush method, may be configured to apply a high bias, such as through use of the corona method to charge the surface of the photosensitive medium 50.

The exposure device 40 scans light corresponding to the print data to the photosensitive medium 50, and may include a laser scanning unit to scan the light generated by a laser diode to the photosensitive medium 50. The exposure device 40 may use a LED or an OLED as a lighting source.

A light window 41 may be disposed at a light passage through which the light, generated by the light source, passes to the photosensitive medium 50. The light window 41 may be transparent and may prevent outside foreign materials from penetrating into the light passage. In this exemplary embodiment, the light window 41 is disposed at a leading end of the exposure device 40. When a foreign material is attached to the light window 41, the foreign material blocks the light so as to create a printing defect. The light window 41 may be configured so that a light window cleaning device (not illustrated) automatically cleans the light window 41 according to a command of the control portion 100. Alternatively, the light window 41 may be configured so that when the control portion 100 alerts a user to clean the light window 41 via the input/output portion 101, the user manually cleans the light window 41.

Furthermore, the exposure device 40 may include cleaning devices to clean all elements of the exposure device 40 that are disposed at the light passage, through which the light passes from the light source to the photosensitive medium 50. For example, when a laser scanning unit uses a laser diode, the light emitted from the light source passes through a collimating lens or a cylinder lens, is reflected by a polygon mirror of a light deflector, passes through an f-theta lens, is reflected by a reflecting mirror, and is scanned onto the surface of the photosensitive medium. Therefore, the exposure device may include cleaning devices to clean surfaces of each of the collimating lens, the cylinder lens, the f-theta lens, the polygon mirror, and the reflecting mirror.

Figure 5:
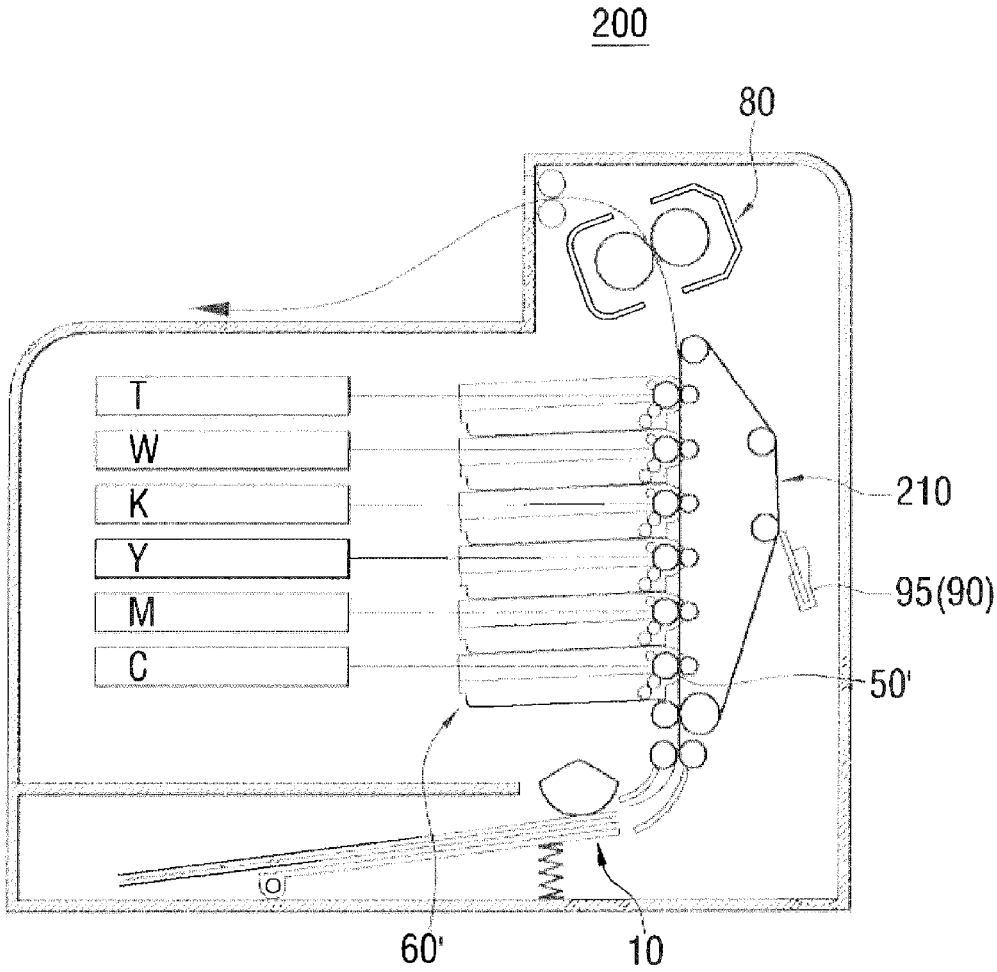
FIG. 5 is a sectional view schematically illustrating an image forming apparatus, according to an exemplary embodiment of the present general inventive concept to have a printing medium convey belt.

The light generated by the exposure device 40 forms electrostatic latent images corresponding to the print data on the photosensitive medium 50. In this exemplary embodiment, a photosensitive belt is used as the photosensitive medium 50. As illustrated in FIGS. 5 and 6, a photosensitive drum 50' and 50" respectively, may be used as the photosensitive medium 50. Staining materials, such as developer remaining after a transfer process, paper dust of the printing medium, outside dust, etc., may become attached to the photosensitive medium 50. To prevent the generation of a printing defect, the staining materials need to be removed.

To clean the staining materials, a cleaning blade 92 may be disposed at a side of the photosensitive medium 50. The cleaning blade 92 may be formed of an abrasion resistant rubber, such as a urethane, a silicone, etc., and removes the staining materials attached on the photosensitive medium 50 using mechanical friction.

Alternatively, the surface of the photosensitive medium 50 may be cleaned using a cleaning roller formed in a cylinder shape or a brush roller including a plurality of bristles instead of the cleaning blade.

Alternatively, while a cleaning bias is being applied to the charging device 30 or the transfer medium 70, the photosensitive medium 50 rotates so that the surface of the photosensitive medium 50 is cleaned. An erasing apparatus (not illustrated) may be disposed nearby the photosensitive medium 50 to apply the cleaning bias to the photosensitive medium 50 so as to clean the surface of the photosensitive medium 50. When there is no print command, the control portion 100 of the image forming apparatus 1 allows the printing medium to pass between the photosensitive medium 50 and the transfer medium 70 so that the staining materials move from the photosensitive medium 50 to the printing medium in order to clean the photosensitive medium 50.

The plurality of developing devices 60 is disposed to face the photosensitive medium 50, and supplies developer to the electrostatic latent images formed on the photosensitive medium 50 so as to develop them into developer images. The image forming apparatus 1 according to this embodiment includes six developing devices 60; however, this does not limit the number of developing devices 60 that the image forming apparatus 1 can have. In other words, the image forming apparatus 1 may have any number of developing devices, such as one developing device 60 or four developing devices 60. The six developing devices 60 may be formed to supply yellow developer, cyan developer, magenta developer, black developer, white developer, and transparent developer, respectively. Instead of the white or transparent developer, light magenta developer, light cyan developer, or another light color developer may be used. Alternatively, the white developer, the transparent developer, the light magenta developer, and the light cyan developer may all be used.

The transfer medium 70 allows the developer images formed on the photosensitive medium 50 to be transferred onto the printing medium. A transfer roller, a printing medium convey belt 210 (see FIG. 5) or an intermediate transfer belt 310 (see FIG. 6) may be used as the transfer medium 70. In this exemplary embodiment, as illustrated in FIG. 1, a transfer roller is used as the transfer medium 70. When the developer images are transferred from the photosensitive medium 50 to the printing medium, some of developer used to form the developer images may be attached to a surface of the transfer medium 70. When the developer is attached to the transfer medium 70, mechanical and electrical properties of the transfer medium 70 may be changed so as to create printing defects. Therefore, it is required to clean the transfer medium 70. A transfer medium cleaning device 93 disposed at a side of the transfer medium 70 may be used to clean the transfer medium 70. Alternatively, a predetermined cleaning bias may be applied to the transfer medium 70 so as to clean the surface of the transfer medium 70. Also, when there is no print command, the control portion 100 of the image forming apparatus 1 allows the printing medium to pass between the photosensitive medium 50 and the transfer medium 70 so that the staining materials move from the transfer medium 70 to the printing medium in order to clean the transfer medium 70.

The fusing device 80 causes the developer images transferred onto the printing medium by the transfer medium 70 to be fixed on the printing medium. To accomplish this, the fusing device 80 is formed to apply heat and pressure to the printing medium. The fusing device 80 may be formed as a roller type, a belt type, or a film type. In this exemplary embodiment, as illustrated in FIG. 1, the roller type fusing device 80 is used.

When a pressure roller and a heat roller of the fusing device 80 apply pressure and heat to the printing medium to fix the developer images onto the printing medium, staining materials, such as excess developer, paper dust of the printing medium, outside dust, etc., may stain surfaces of the pressure roller and/or the heat roller. If the pressure roller or the heat roller of the fusing device 80 is stained, printing defects may be generated. Therefore, cleaning of the fusing device 80 is required. Fuser cleaning devices 94 disposed at a side of each of the pressure roller and the heat roller of the fusing device 80 may be used to clean surfaces of the pressure roller and the heat roller. Also, a predetermined cleaning bias may be applied to the fusing device 80 so as to clean the surfaces of the pressure roller and heat roller. Alternatively, when there is no print command, the image forming apparatus 1 allows the printing medium to pass between the pressure roller and the heat roller of the fusing device 80 so that the staining materials move from the pressure roller or the heat roller to the printing medium in order to clean the fusing device 80.

Furthermore, the image forming unit 20 may include a density detecting sensor (not illustrated). The density detecting sensor measures density of images formed on the photosensitive medium 50, the transfer medium 70, or the printing medium, and adjusts image density on the basis of the measured density. Also, the image forming unit 20 may include a potential density detecting sensor (not illustrated) that measures potential density on the photosensitive medium 50 or the transfer belt so as to allow the photosensitive medium 50 or the transfer belt to be adjusted to a predetermined potential level. Also, the image forming unit 20 may form a patch in a visual image or an electric potential latent image on the photosensitive medium 50, the transfer belt, or the printing medium, and may include a patch detecting sensor (not illustrated) to detect the patch. The image forming unit 20 may use the patch detecting sensor to detect the patch and to adjust the image density, the potential density, or registration alignment.

If the density detecting sensor, the potential density detecting sensor, or the patch detecting sensor is stained by staining materials, they may not operate normally, resulting in detecting errors that may generate printing defects. Accordingly, cleaning of the density detecting sensor, the potential density detecting sensor, or the patch detecting sensor is required. The control portion 100 may be configured to automatically clean the density detecting sensor, the potential density detecting sensor, or the patch detecting sensor using sensor cleaning devices (not illustrated) disposed near each of them. Alternatively, the image forming unit 20 may be configured so that when the control portion 100 alerts a user to clean the density detecting sensor, the potential density detecting sensor, or the patch detecting sensor via the input/output portion 101, the user manually cleans the density detecting sensor, the potential density detecting sensor, or the patch detecting sensor.

The discharging unit 4 discharges the printing medium on which images are formed while passing through the image forming unit 20 to the outside of the case 2.

The control portion 100 controls the printing medium feeding unit 10, the image forming unit 20, and the discharging unit 4 to form images on the printing medium, and controls the cleaning unit 90 to clean at least one stained portion of the image forming unit 20. The control portion 100 may be connected with a host 400, such as a personal computer and the input/output portion 101. The input/output portion 101 may include a display portion to inform the user of a state of the image forming apparatus 1 and the input portion, which the user uses to input control commands with respect to the image forming apparatus 1.

Referring to FIG. 2, the control portion 100 may include a main control portion 110, a print mode storing portion 140, a cleaning start determining portion 120, a cleaning control portion 130, and a memory 150.

When a print command is received from the host 400, the main control portion 110 controls the printing medium feeding unit 10 and the image forming unit 20 to form images corresponding to received print data on the printing medium.

The print mode storing portion 140 stores print modes that the user inputs via the input/output portion 101 or the host 400. Referring to FIG. 3, the print mode may include a color selection mode to have a mono print mode, a four color print mode, and a five or more multi-color print mode. Each of the color selection modes may include a resolution selection mode in which resolution can be selected, a print density selection mode in which print density can be selected, a developer saving selection mode, a print data selection mode in which one among normal, text, or image can be selected according to the type of the print data, a feed method selection mode in which either simplex or duplex can be selected, a printing media selection mode in which a type of printing media can be selected, and an environment selection mode in which an environment for the image forming apparatus 1 to be installed in can be selected.

The amount of developer consumed (or used) to form the same image varies according to the print mode. When an image of one dot is formed using black developer in the mono print mode, the amount of developer consumed in each of the print mode is relatively illustrated in FIG. 3. Data corresponding to relative usage amount of developer, as illustrated in FIG. 3, are measured using a Samsung laser printer ML-2150. However, FIG. 3 does not illustrate the usage amount of developer with respect to each color in the four color print mode and the five or more multi-color print mode. The amount of developer used varies according to types and structures of laser printers, and properties of a particular developer. Therefore, the usage amount of the developer may be measured by print tests with respect to each of the print modes.

Referring to a resolution column of FIG. 3, when one dot is printed at a resolution of 600 dpi (dot per inch), developer of 1 is used. The term "developer of 1" refers to a standard amount of developer used when one dot is printed in 600 dpi. The amount of developer used according to a color selection mode is expressed in proportion to the standard amount of developer used when one dot is printed in 600 dpi. For example, when one dot is printed in 1200 dpi, developer of 1.5, or 1.5 times the standard amount of developer used when one dot is printed in 600 dpi, is used. That is, the amount of the developer used in resolution of 1200 dpi is increased by approximately 50% as compared with that in resolution of 600 dpi.

Also, the user can select one among light, medium, and dark as the print density so that the density of images printed on the printing medium may correspond to the selected print density, and may either be light, medium, or dark. Therefore, the amount of developer used to form the image of one dot varies according to the print density. Referring to a print density column of FIG. 3, when one dot is printed in the medium density, the usage amount of the developer is approximately 1. In the light density, developer of 0.8 per dot is used, and in the dark density, developer of 1.2 per dot is used.

When the developer saving mode is selected, developer used per dot is approximately 0.7. Therefore, the developer saving mode uses developer of 30 percent (%) less than a normal print mode in that the developer saving mode is not selected.

Also, referring to FIG. 3, the amount of developer used to form an image of one dot varies according to the print data type or the feed method.

Furthermore, the usage amount of the developer varies according to the environment in which the image forming apparatus 1 is installed. For example, if the amount of developer used to form an image of one dot in normal temperature and normal humidity (NN) is approximately 1, the amount of developer used to form the image of one dot in low temperature and low humidity (LL) is approximately 0.7. And the amount of developer used to form the image of one dot in high temperature and high humidity (HH) is approximately 1.2.

Also, the amount of developer used to form the image of one dot varies according as the print mode is the mono print mode or the color print mode.

In general, to form color images, four color developers, such as cyan, magenta, yellow, and black, may be used. The four color developers may have differences in hue, brightness, and chroma so that the developers may be different from one another in a basic resin and/or additives such as internal additives and external additives. For example, the various color developers may be different from one another in type of developer, usage amount of colorant to show various colors, etc. For example, when forming the color "orange", the usage amount of a yellow developer may be greater than the usage amount of a cyan developer. Therefore, the type of developer and/or an adding ratio of a charge control agent, such as silica, etc., to control the charge amount of the developer, may vary according to the colors of the developers. As a result, the amount of the developer used to form the image of one dot varies according to each color of the developers. In other words, the amount of developer used to form a predetermined image may be determined not simply by the number of dots to form the predetermined image, but also by the color and the print mode used to form the predetermined image. Therefore, although images have the same number of dots, if the color and the print mode of each of the dots to form the images are different from each other, the usage amount of developer used to form one dot also is different.

When forming color images, a first color developer may be transferred onto the printing medium, and then a second color developer may be overlapped on and/or nearby the first color developer so as to form a specific color image. For example, cyan developer is transferred on and/or nearby a yellow dot formed on the printing medium by yellow developer so as to turn the image green. As described above, two or more among four color developers may be used to form a specific color so that the four color developers are different from one another in usage amount thereof. Therefore, the usage amount of each of the color developers used to form each color of the color image may be calculated, and then the calculated usage amounts of the four color developers may be summed to get a total usage amount of the developer.

Additionally, when the color selection mode has a five or more multi-color print mode, two or more developers may be used to form a specific color so that the color developers are different from one another in usage amount thereof. If the additional color developers are light colors, such as light magenta, light cyan, etc., the total usage amount of the developers may be calculated by a similar method to the method to calculate the total usage amount of the developers in the four color print mode as described above. However, when soft images such as soft shade color pictures are printed, the usage amount of the light color developer is relatively high compared to the other developers, so that the usage amount of each of the color developers may be calculated, and then the calculated usage amounts of all the color developers may be summed to get a total usage amount of the developer.

Alternatively, when the five or more multi-color print mode also uses white developer or transparent developer instead of the light magenta or light cyan, a method to calculate the total usage amount of the developer is similar to the method as described above. However, the purpose of forming images may be different, and therefore different controls may be required. For example, the white developer may be used to lighten the color of the developers, but it may mainly be used to provide a specific surface effect, such as patterns, the feel of a material, brilliance, removal of stain, etc., upon portions of the printing medium in which the color developers are not printed on. The transparent developer may be used for similar purposes as the white developer. In addition, the transparent developer may be used to be coated on and protect the colored images. Therefore, when the white or transparent developer is used to print, the usage amount of the white or transparent developer may be much larger than that of the color developers.

Therefore, when a light color developer or a white/transparent developer is used to print, coverage of the printed image may rapidly be increased. For example, a greater amount of developer may be used when printing an image using a developer of a light color and/or a white/transparent color, so that the difference of the usage amount of the developer of a light color and/or a white transparent color is greater than the difference of the usage amount of the developer in the mono print mode as illustrated in FIG. 3. In other words, when the four-color developers (general color developers) are used, twice as much developer may be used as compared to when a mono color developer is used. When the five or more color developers (for example, including light color developer, or white/transparent developer) are used, the usage amount of the developer may be much larger than when the four color developer is used.

As described above, when the usage amount of the developer is calculated with respect to each of the color developers and each of the print modes, and then the calculated usage amounts of the developers are added together, the total usage amount of the developers that the image forming apparatus 1 has used to form predetermined images may precisely be calculated.

An operation to calculate the usage amount of each of the color developers according to color and print mode with respect to each of at least one dot to form the images and to accumulate the calculated values may also apply a load to the control portion 100 that processes the print data and performs a printing operation. Therefore, the control portion 100 of the image forming apparatus 1 may use high efficient memory and a CPU (Central Processing Unit) capable of efficiently processing the load.

In order to reduce the amount of processing data, the usage amount of the color developers used to form the color of each of at least one dot may be calculated together. The usage amount of the developer may be calculated according to the print mode of at least one dot to form the images, and the calculated usage amount of the developer may be accumulated. In this case, the usage amount of the developer used to form one dot (hereinafter, referred to developer usage amount per dot) in each condition of the resolution selection mode, the print density selection mode, the developer saving selection mode, the print data selection mode, the feed method selection mode, and the environment selection mode with respect to each of the mono print mode, the four color print mode, and the five or more multi-color print mode may previously be determined, and the respective usage amount of the developer may be stored in a memory 150 of the control portion 100. Then, the control portion 100 calculates the number of the dots to form a predetermined image, and multiplies the calculated number of dots by the developer usage amount per dot corresponding to the selected print mode to calculate total usage amount of the developer. In this case, the control portion 100 is required to know only the print mode which is selected among the mono print mode, the four color print mode, and the five or more multi-color print mode and the print mode which is selected among the resolution selection mode, the print density selection mode, the developer saving selection mode, the print data selection mode, the feed method selection mode, and the environment selection mode so that a CPU of the control portion 100 does not receive a large load. As a result, a low performance memory and a low performance CPU can be used so that the manufacturing cost of the control portion 100 may be decreased.

Figure 4:
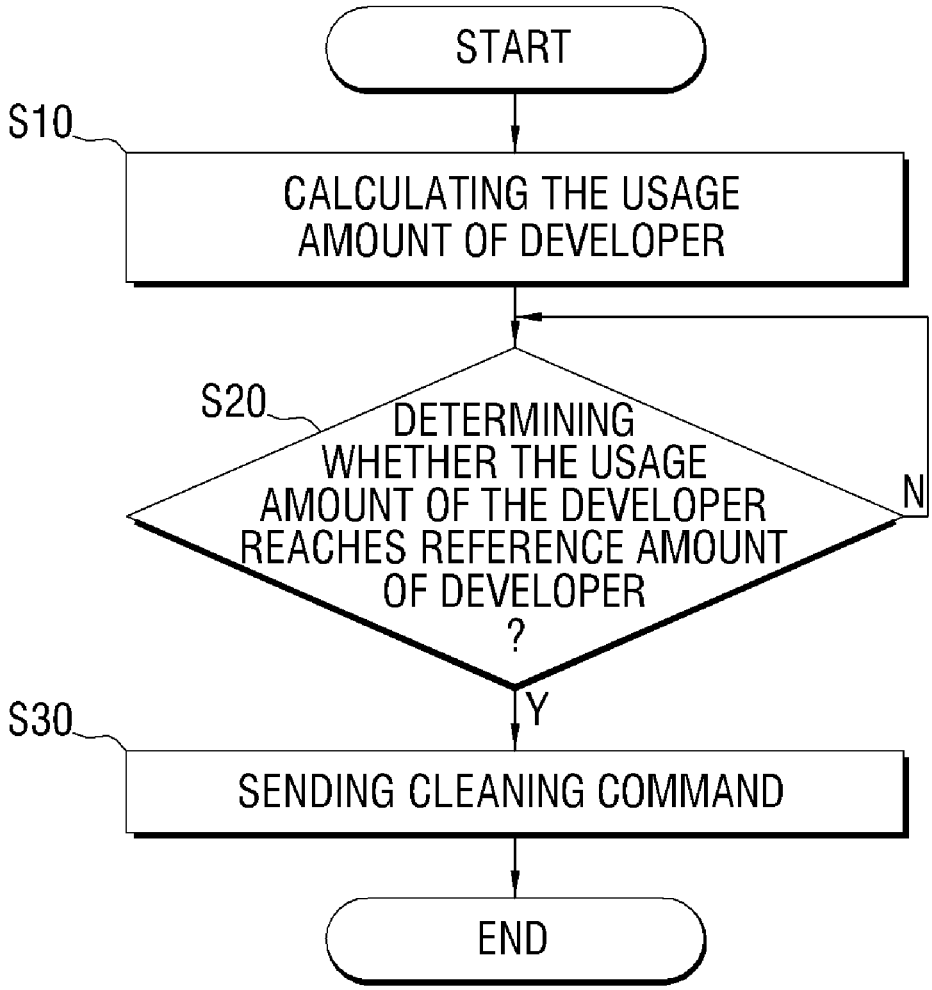
FIG. 4 is a flow chart illustrating a method of a control portion of the image forming apparatus of FIG. 1 to determine a start-time to perform a cleaning operation.

The cleaning start determining portion 120 calculates the total usage amount of the developer, as illustrated in operation S10 of FIG. 4, and determines whether the calculated total usage amount of the developer reaches a reference amount of the developer (operation S20). To calculate the total usage amount of the developer the cleaning start determining portion accumulates the developer usage amount per dot with respect to all dots used to form the printed images. The reference amount of the developer refers to an amount of the developer used until some portions of the image forming unit 20 are stained by the developer used to form the images. In other words, the reference amount of the developer is an amount of developer corresponding to the staining of various portions of the image forming apparatus. Also, the reference amount of the developer may be determined so that the stained portion does not generate a print defect. The reference amount of the developer is previously determined by tests. The reference amount of the developer may be stored in the memory 150 of the control portion 100. Also, the reference amount of the developer may be changed arbitrarily by the user.

The stained portions of the image forming unit 20 may include the charging device 30, the exposure device 40, the photosensitive medium 50, the transfer medium 70, the fusing device 80, and the density detecting sensor.

Also, two or more reference amounts of the developer may be set in the control portion 100 according to the number of portions in which stains occur. For example, the accumulated usage amount of the developer at which cleaning of the photosensitive medium 50 is started may be referred to as a first reference amount of the developer, and the accumulated usage amount of the developer at which cleaning of the fusing device 80 is started may be referred to as a second reference amount of the developer. If the accumulated usage amount of the developer at which cleaning of each of various stained portions is started is the same as or similar to each other, one accumulated usage amount of the developer may be used to determine whether to start the cleaning of the various stained portion. For example, in case that the accumulated usage amount of the developer at which cleaning of each of the charging device 30 and the exposure device 40 is started is similar to the first reference amount of the developer at which cleaning of the photosensitive medium 50 is started, when the accumulated usage amount of the developer reaches the first reference amount of the developer, cleaning operations of the charging device 30, the exposure device 40, and the photosensitive medium 50 can be started substantially at the same time.

To determine the reference amount of the developer, the cleaning strength and/or time required to clean the stained portions with the cleaning unit 90 may be considered. For example, when a predetermined bias is applied to the fusing device 80 so as to remove the staining materials, a large cleaning bias effectively cleans the fusing device 80 so that the reference amount of the developer may be increased. Also, when the same cleaning bias is applied to the fusing device 80, the more time it takes to clean the fusing device 80, the more effectively the fusing device 80 is cleaned. Therefore, the reference amount of the developer may be increased. The cleaning bias and the cleaning time may be controlled by a cleaning control portion 130 of the control portion 100.

When the usage amount of the developer reaches the reference amount of the developer, the cleaning start determining portion 120 may inform the main control portion 110 to start a cleaning operation. Then, the main control portion 110 completes any printing operation that may still be in progress and sends a cleaning command (operation S30) to the cleaning control portion 130. The cleaning control portion 130 controls the cleaning unit 90 to perform a cleaning operation.

The cleaning unit 90 may be formed to clean the stained portions of the image forming unit 20. For example, when each of the charging device 30, the exposure device 40, the photosensitive medium 50, the transfer medium 70, and the fusing device 80 of the image forming unit 20 is stained, to remove the stains thereof the cleaning unit 90 may include the charging cleaning device 91, the light window cleaning device (not illustrated), the photosensitive medium cleaning device 92, the transfer medium cleaning device 93, and the fuser cleaning device 94.

If the image forming unit 20 does not have the cleaning unit 90, the control portion 100 may inform the user that a manual cleaning of the stained portions of the image forming unit 20 is necessary via the display portion of the input/output portion 101.

In the above explanation, the cleaning start determining portion 120 is configured to determine when to start the cleaning of the stained portions of the image forming unit 20 of the image forming apparatus 1 using the usage amount of the developer.

However, the cleaning start determining portion 120 may determine the start time of the cleaning operation with respect to the image forming unit 20 by means other than the usage amount of the developer. As the usage amount of the developer is increased, the number of the printing media having been printed on tends to increase as well. Accordingly, a point in time when the image forming unit 20 is stained varies according to different types of printing media. Therefore, the cleaning start determining portion 120 may be configured to determine the start time of the cleaning operation using the number of the printing medium that have been printed on.

For example, a reference value of the number of printing media (a number of standard printing media that may be printed on until a cleaning operation is necessary) may be stored in the memory 150 of the control portion 100. The cleaning start determining portion 120 counts the number of the printing media that have been printed on and compares the accumulated (or total) number with the reference value of the number of the printing media. When the total number of the printing media reaches the reference value of the number of the printing media, the cleaning start determining portion 120 may send the main control portion 110 a signal to start a cleaning operation. Then, the main control portion 110 controls the cleaning unit 90 via the cleaning control portion 130 to clean the stained portions of the image forming unit 20.

How much the image forming unit 20 is stained may be depend on the sizes and/or types of the printing media. In other words, the stained degree of the stained portions generated by common paper of size A4 may be smaller than the stained degree of the stained portions generated by common paper of size A3. Also, when cotton paper is used as the printing medium, a lot of paper dust is generated, and the fusing operation becomes difficult so that the likelihood of staining the image forming unit 20 is greater than when using a common type paper. Therefore, the reference value of the number of the printing media to determine the start time of the cleaning operation may be varied according to the size and types of the printing media.

The image forming apparatus 1 may print using various types and/or sizes of paper, for example, a common paper of size A4, and a common paper of size A3. Alternatively, the image forming apparatus 1 may print using cotton paper while also printing using a common paper. When two or more types or sizes of printing media are used to print, one type of printing medium with a specific size may be determined as a standard printing medium. And each of various printing media, that is, non-standard printing medium, may have a weight that differs from the weight of the standard printing medium. Therefore, the number of non-standard printing media used to print can be converted into the number of standard printing media based on weight. For example, A4 paper may be determined as the standard printing medium with a weight of "1", used to represent a standard weight for comparison purposes. A A3 paper may have the weight of "2", in other words, twice the weight of the standard printing medium, A4 paper. Then, when one sheet of A3 paper is used, the converting number of the printing medium used to print is 2. In other words, according to this example, printing one sheet of A3 paper is considered equivalent to printing two sheets of the standard printing medium, A4 paper. Therefore, the cleaning start determining portion 120 sums the number of the standard printing media printed and the converting number of the non-standard printing media printed to calculate the total number of the printing media having been printed. Various types of paper may have a corresponding weight, including, but not limited to, cotton paper and special paper such as envelopes, postcards, label paper, laminating films, etc.

Also, the number of printing media may be referred to as a "reference value", and may be set in the control portion according to the number of portions in which a stain occurs in the same manner as the reference amount of the developer. There may be more than one reference value of the number of printing medium. For example, the number of the printing media at which cleaning of the photosensitive medium 50 is started may be referred to as a first reference value of the number of printing media, and the number of the printing media at which cleaning of the fusing device 80 is started may be referred to as a second reference value of the number of the printing media. If the number of the printing media at which cleaning of each of various stained portions is started is the same as, or similar to, each other, one reference value of the number of the printing media may be used to determine whether to start the cleaning of the various stained portions. For example, if the number of the printing media at which the cleaning of each of the charging device 30 and the exposure device 40 is started is similar to the first reference value of the number of the printing media at which cleaning of the photosensitive medium 50 is started, when the number of the printing media reaches the first reference value of the number of the printing media, cleaning operations of the charging device 30, the exposure device 40, and the photosensitive medium 50 are started at substantially the same time.

Hereinafter, operation of the image forming apparatus 1 according to an exemplary embodiment of the present general inventive concept to have the structure as described above will be explained with reference to FIGS. 1, 2, and 4.

When a print command is received from the host 400, the control portion 100 controls the printing medium feeding unit 10 to pick up a printing medium and to feed it toward the image forming unit 20.

At the same time, the charging device 30 charges the photosensitive medium 50 with a predetermined bias, and the exposure device 40 scans light to form electrostatic latent images corresponding to the print data on the photosensitive medium 50.

Then, the six developing devices 60 supply developers to develop the electrostatic latent images formed on the photosensitive medium 50 into developer images. The six developing devices 60 supply developers according to the print mode that the user selected via the input/output portion 101. The user can select one color mode among the mono print mode, the four color print mode, and the five or more multi-color print mode. Also, the user can select resolution, print density, developer saving selection mode, print data type, feed method, and environment in the selected color mode. When the user does not select the print mode, the image forming apparatus 1 performs a printing operation in a predetermined print mode set in the control portion 100 thereof. In this exemplary embodiment, as illustrated in FIG. 3, the resolution is selected in either 600 dpi or 1200 dpi, the print density is selected in either light, medium, or dark, and the print data type is selected in either normal, text, or image. Also, the feeding method is selected in either simplex or duplex modes, and the environment is selected in either low temperature and low humidity, normal temperature and normal humidity, or high temperature and high humidity. The print modes selected by the user are stored in the print mode storing portion 140 of the control portion 100.

The transfer medium 70 allows the developer images formed on the photosensitive medium 50 to be transferred onto the printing medium entering between the photosensitive medium 50 and the transfer medium 70.

When the printing medium passes through the fusing device 80, the fusing device 80 applies heat and pressure to the printing medium so as to allow the transferred developer images to be fixed on the printing medium. The printing medium having the images fixed thereon is discharged outside of the case 2 by the discharging unit 4.

While the main control portion 110 of the control portion 100 is controlling the printing medium feeding unit 10, the image forming unit 20, and the discharging unit 4 to perform a printing operation, the cleaning start determining portion 120 determines the amount of the developer used to form the images, and calculates the total usage amount of the developer. Then, the cleaning start determining portion 120 determines whether the total usage amount of the developer reaches the reference amount of the developer.

When the print data covers a large portion of the printing medium, a large amount of the developer is used, so that the total usage amount of the developer may reach the reference amount of the developer earlier than when less developer is used. For example, the usage amount of the developer for printing the print data with 10% coverage of a printing medium is approximately twice as much as the usage amount of the developer for printing the print data with 5% coverage of a printing medium. Therefore, the total usage amount of the developer may reach the reference amount of the developer earlier when the print data has 10% coverage of a printing medium than when the print data has 5% coverage of a printing medium.

When the usage amount of the developer reaches the reference amount of the developer, the cleaning start determining portion 120 sends the main control portion 110 a cleaning start signal.

When the main control portion 110 receives the cleaning start signal, the main control portion 110 completes any printing operation that may still be in progress and sends a cleaning command to the cleaning control portion 130. When the cleaning command is received, the cleaning control portion 130 controls the cleaning unit 90 to clean the stained portions.

When the memory 150 of the control portion 100 stores two reference amount of the developer, the cleaning start determining portion 120 determines whether the total usage amount of the developer reaches either the first or the second reference amount of the developer. When the total usage amount of the developer is the same as the first reference amount of the developer, the cleaning start determining portion 120 sends the main control portion 110 a first cleaning signal. Also, when the total usage amount of the developer is the same as the second reference amount of the developer, the cleaning start determining portion 120 sends the main control portion 110 a second cleaning signal. When the main control portion 110 receives the first or second cleaning start signal, the main control portion 110 completes any printing operation that may still be in progress and sends a first cleaning command or a second cleaning command to the cleaning control portion 130. When the first or second cleaning command is received, the cleaning control portion 130 controls the cleaning unit 90 corresponding to the first or second cleaning command to clean the stained portions. In other words, different stained portions may be cleaned at different times based on corresponding reference amounts of the developer.

After the cleaning operation is completed, the cleaning control portion 130 sends a cleaning complete signal to the main control portion 110. Then, the main control portion 110 restarts a printing operation, and the cleaning start determining portion 120 begins to calculate the usage amount of the developer based on the new printing operation.

The image forming apparatus 1 according to an exemplary embodiment of the present general inventive concept calculates the amount of the developer that has been used to form images, and determines the start time of the cleaning operation using the calculated amount of the developer. Therefore, stained portions of the image forming unit 20 may effectively be cleaned.

FIGS. 5 and 6 illustrate an image forming apparatus according to an exemplary embodiment of the present general inventive concept to have an image forming unit formed in an alternative structure to that of the image forming unit 20 as described above.

In FIG. 5, the image forming apparatus 200 is configured so that each of six developing devices 60' has a photosensitive drum 50' disposed within, and a printing medium convey belt 210 to allow a printing medium to pass the six photosensitive drums 50' disposed inside the six developing devices 60'. Therefore, developer images on the six photosensitive drums 50' are overlappingly transferred onto the printing medium conveyed by the printing medium convey belt 210 to form color images.

A cleaning unit 90 of the image forming apparatus 200 may include a convey belt cleaning device 95 to clean the printing medium convey belt 210 and photosensitive drum cleaning devices (not illustrated) to clean each of the six photosensitive drums 50' disposed inside the six developing devices 60'.

A control portion of the image forming apparatus 200 of FIG. 5 may control the cleaning unit 90 to clean stained portions. The control portion of the image forming apparatus 200 may be the same as the control portion 100 as described above; therefore, detailed descriptions thereof are not repeated.

In FIG. 6, the image forming apparatus 300 includes a photosensitive drum 50' on which color images are formed, and an intermediate transfer belt 310 on which the color images formed on the photosensitive drum 50" are transferred and which allows the transferred color images to be transferred onto a printing medium. That is, the photosensitive drum 50" is used as the photosensitive medium, and the intermediate transfer belt 310 is disposed between the photosensitive drum 50" and the transfer medium 70. Therefore, a cleaning unit 90 of the image forming apparatus 300 of FIG. 6 may include a photosensitive drum cleaning device 92' to clean the photosensitive drum 50" and a transfer belt cleaning device 96 to clean the intermediate transfer belt 310.

A control portion of the image forming apparatus 300 of FIG. 6 may control the cleaning unit 90 to clean stained portions. The control portion of the image forming apparatus 300 may be the same as the control portion 100 as described above; therefore, detailed descriptions thereof are not repeated.

Hereinafter, a method to clean stained portions of an image forming apparatus according to an embodiment of the present general inventive concept will be explained in detail with reference to FIG. 1, FIG. 2, FIG. 7 and FIG. 8.

Figure 7:
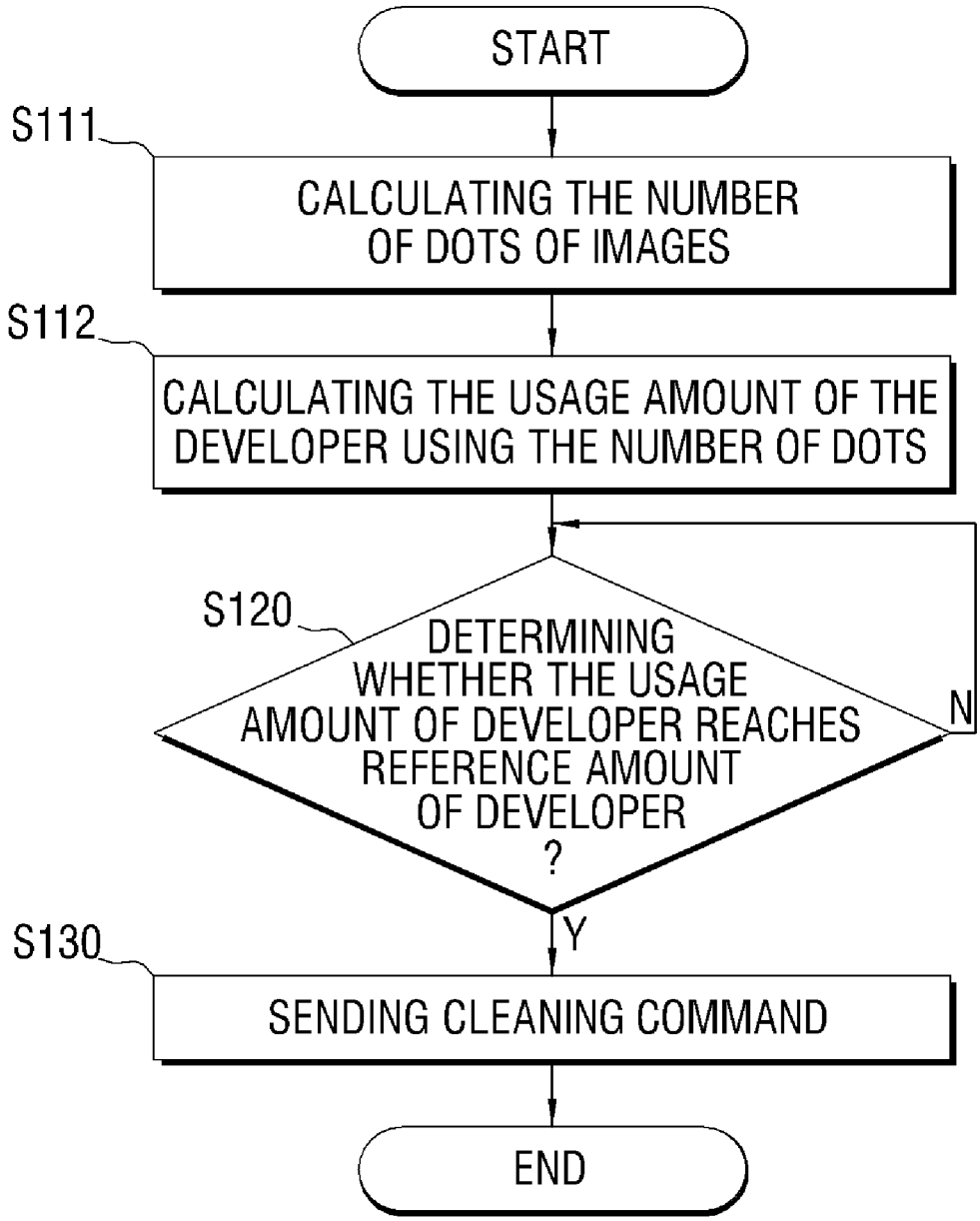
FIG. 7 is a flow chart illustrating a method to clean a stained portion of an image forming apparatus, according to an exemplary embodiment of the present general inventive concept.

FIG. 7 illustrates a flow chart of a cleaning method to determine whether to start a cleaning operation to clean stained portions on the basis of the usage amount of developer in the image forming apparatus 1 to use developer to form images.

The control portion 100 of the image forming apparatus 1 calculates the number of dots that constitute the formed images (operation S111). Then, the control portion 100 uses the calculated number of dot to calculate the amount of developer used to form the images (operation S112).

At this time, the control portion 100 multiplies the calculated number of dots of the images and the developer usage amount per dot to calculate the total amount of developer used to form the images. The developer usage amount per dot is determined according to the mono print mode, the four color print mode, the five or more multi-color print mode, the resolution selection mode, the print density selection mode, the developer saving selection mode, the print data selection mode, the feed method selection mode, and the environment selection mode, and is stored in the memory 150 of the control portion 100. Therefore, the control portion 100 reads the developer usage amount per dot corresponding to the selected print modes from the memory 150.

Alternatively, when calculating the usage amount of the developer using the calculated dots of the images, the control portion 100 can consider the color of each of the dots. In other words, the control portion 100 calculates the usage amount of each of one or more color developers used to form each color dot according to the print modes selected among the resolution selection mode, the print density selection mode, the developer saving selection mode, the print data selection mode, the feed method selection mode, and the environment selection mode and accumulates the calculated usage amount for reach dot so as to calculate the total usage amount of the developer.

Then, the control portion 100 determines whether the total usage amount of the developer reaches the reference amount of the developer (operation S120). The reference amount of the developer is stored in the memory 150 of the control portion 100.

When the total usage amount of the developer reaches the reference amount of the developer, the control portion 100 sends a cleaning command to the cleaning unit 90 in order to clean the stained portions (operation S130). The image forming apparatus 1 may include the photosensitive medium 50, the transfer medium 70, the exposure device 40, the charging device 30, the fusing device 80, and the density detecting sensor. Therefore, when the image forming apparatus 1 is performing a printing operation using developer, the photosensitive medium 50, the transfer medium 70, the light window 41 of the exposure device 40, the charging device 30, the fusing device 80, and the density detecting sensor may be stained by staining materials such as developer. Also, the image forming apparatus 1 may include the cleaning unit 90 formed to clean stained portions of each of the photosensitive medium 50, the transfer medium 70, the light window 41 of the exposure device 40, the charging device 30, the fusing device 80, and the density detecting sensor. Therefore, when the cleaning command is received from the control portion 100, the cleaning unit 90 cleans the stained portions of each of the photosensitive medium 50, the transfer medium 70, the light window 41 of the exposure device 40, the charging device 30, the fusing device 80, and the density detecting sensor.

Figure 8:
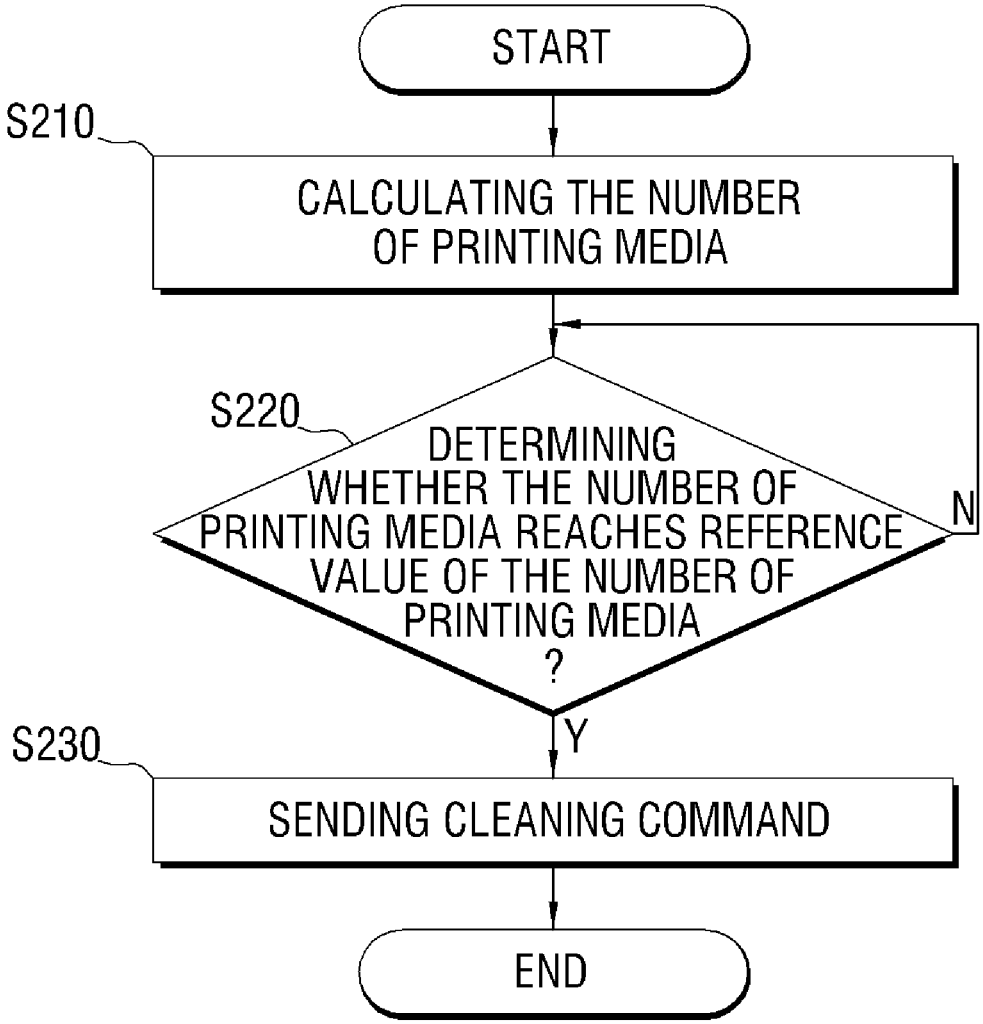
FIG. 8 is a flow chart illustrating a method to clean a stained portion of an image forming apparatus, according to an exemplary embodiment of the present general inventive concept.

FIG. 8 illustrates a flow chart of a cleaning method to determine whether to start a cleaning operation to clean stained portions on the basis of the number of the printing media having been printed in the image forming apparatus 1 to use developer to form images, and to start the cleaning operation.

The control portion 100 of the image forming apparatus 1 calculates the number of the printed printing media (operation S210). Then, the control portion 100 determines whether the calculated value of the number of the printed printing media reaches the reference value of the number of the printing media (operations S220). The reference value of the number of the printing media may be determined according to type and size of the printing media, and may be stored in the memory 150 of the control portion 100. Alternatively, the reference value of the number of the printing media may be determined by the number of the standard printing media, and the number of the printing media of a different type and/or size from the standard printing media may be calculated using the weight with respect to the standard printing media.

When the number of the printed printing media reaches the reference value of the number of the printing media, the control portion 100 sends the cleaning unit 90 a cleaning command in order to clean the stained portions of the image forming apparatus 1 (operation S230).

Although exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus, comprising:

a case;

a printing medium feeding unit disposed in the case to feed printing media;

an image forming unit disposed in the case to form images on the printing media fed from the printing medium feeding unit using developer, and including a first portion to be stained and a second portion to be stained different than the first portion, each of the first and second portions becoming stained when the images are formed; and a control portion to control the image forming unit to form the images in a plurality of print modes, the control portion to send a first cleaning command to clean the first stained portion when the amount of the developer used by the image forming unit reaches a first reference amount of the developer corresponding to the first stained portion or when the number of the printing media supplied by the printing medium feeding unit reaches a first reference value of the number of the printing media corresponding to the first stained portion, the control portion to send a second cleaning command to clean the second stained portion when the amount of the developer used by the image forming unit reaches a second reference amount of the developer corresponding to the second stained portion or when the number of the printing media supplied by the printing medium feeding unit reaches a second reference value of the number of the printing media corresponding to the second stained portion.

2. The image forming apparatus of claim 1, wherein the control portion calculates a sum of the number of dots of the images formed by the image forming unit, reads the developer usage amount per dot corresponding to a selected print mode from a memory, and multiplies the sum of the number of dots and the developer usage amount per dot to calculate a total usage amount of the developer.

3. The image forming apparatus of claim 2, wherein the developer usage amount per dot is determined according to at least one among a mono print mode, a four color print mode, a five or more multi-color print mode, a resolution selection mode, a print density selection mode, a developer saving selection mode, a print data selection mode, a feed method selection mode, a printing media selection mode, and an environment selection mode.

4. The image forming apparatus of claim 1, wherein the control portion calculates the amount of each of at least one color developer used to form at least one dot of the image according to at least one mode selected among a resolution selection mode, a print density selection mode, a developer saving selection mode, a print data selection mode, a feed method selection mode, a printing media selection mode, and an environment selection mode and calculates a total usage amount of the developer.

5. The image forming apparatus of claim 1, wherein the first and second reference values of the number of printing media are determined according to type and/or size of the printing medium, and are stored in a memory of the control portion.

6. The image forming apparatus of claim 1, wherein the first and second reference values of the number of printing media are determined as the number of standard printing media, and the number of printing media different from the standard printing media in size and/or type is calculated based on a weight with respect to the standard printing media.

7. The image forming apparatus of claim 1, further comprising:

a cleaning unit to clean at least one of the first and second portions to be stained of the image forming unit;

wherein the control portion sends the first and/or second cleaning commands to control the cleaning unit.

8. The image forming apparatus of claim 7, wherein the control portion controls the cleaning unit for a period of time during which the first and second portions to be stained are cleaned.

9. The image forming apparatus of claim 7, wherein when the cleaning unit applies bias to clean the first and second portions to be stained, the control portion controls an absolute value magnitude of the bias to be applied by the cleaning unit.

10. The image forming apparatus of claim 1, wherein the image forming unit includes at least one of a photosensitive medium, a transfer medium, an exposure device, a charging device, a fusing device, and a density detecting sensor, and wherein during a printing operation, at least one of the photosensitive medium, the transfer medium, the exposure device, the charging device, the fusing device, and the density detecting sensor is stained by the developer.

11. The image forming apparatus of claim 1, wherein first and second cleaning operations performed by the first and second cleaning commands include a different cleaning time, cleaning strength, and cleaning cycle.

12. A method to clean at least one stained portion of an image forming apparatus that uses developer to form an image, the method comprising:

determining a first stained portion and a second stained portion different from the first stained portion;

calculating a number of dots of the formed image;

calculating a usage amount of the developer using the number of dots;

determining whether the usage amount of the developer reaches a first reference amount of the developer corresponding to the first stained portion and determining a second reference amount of the developer corresponding to the second stained portion;

sending a first cleaning command to clean the first stained portion when the usage amount of the developer reaches the first reference amount of the developer; and sending a second cleaning command to clean the second stained portion when the usage amount of the developer reaches the second reference amount of the developer.

13. The method of claim 12, wherein the calculating the usage amount of the developer using the number of dots includes multiplying the number of dots and a developer usage amount per dot.

14. The method of claim 13, wherein the developer usage amount per dot is determined according to at least one among a mono print mode, a four color print mode, a five or more multi-color print mode, a resolution selection mode, a print density selection mode, a developer saving selection mode, a print data selection mode, a feed method selection mode, a printing media selection mode, and an environment selection mode.

15. The method of claim 12, wherein the calculating the usage amount of the developer using the number of dot includes calculating an amount of each of at least one color developer used to form at least one dot of the image according to at least one mode selected among a resolution selection mode, a print density selection mode, a developer saving selection mode, a print data selection mode, a feed method selection mode, a printing media selection mode, and an environment selection mode, and calculating a total usage amount of the developer.

16. The method of claim 12, wherein the image forming apparatus includes at least one of a photosensitive medium, a transfer medium, an exposure device, a charging device, a fusing device, and a density detecting sensor, and wherein during a printing operation, at least one of the photosensitive medium, the transfer medium, the exposure device, the charging device, the fusing device, and the density detecting sensor is stained by the developer.

17. The method of claim 16, wherein each of the photosensitive medium, the transfer medium, the exposure device, the charging device, the fusing device, and the density detecting sensor includes a cleaning unit formed to clean a stained portion of each of the at least one of the photosensitive medium, the transfer medium, the exposure device, the charging device, the fusing device, and the density detecting sensor.

18. A method to clean a stained portion of an image forming apparatus that uses developer to form an image on printing media, the method comprising:

determining a first stained portion and a second stained portion different from the first stained portion;

calculating a number of the printing media being printed;

determining whether the number of the printing media reaches a first reference value of the number of the printing media corresponding to the first stained portion and determining a second reference value of the number of the printing media corresponding to the second stained portion; and sending a first cleaning command to clean the first stained portion when the number of the printing media reaches the first reference value of the number of the printing media and sending a second cleaning command to clean the second stained portion when the number of the printing media reaches the second reference value of the number of the printing media.

19. The method of claim 18, wherein the reference value of the number of the printing media is determined according to type and/or size of the printing medium.

20. The method of claim 18, wherein the reference value of the number of printing media is determined as the number of standard printing media, and the number of printing media different from the standard printing media in size and/or type is calculated based on a weight with respect to the standard printing media.

* * * * *